US008820401B2

(12) United States Patent
Chung

(10) Patent No.: US 8,820,401 B2
(45) Date of Patent: Sep. 2, 2014

(54) OIL-PRESSURE TYPE FIXED PISTON SAMPLER

(75) Inventor: Sung Gyo Chung, Busan (KR)

(73) Assignee: Dong-A University Research Foundation for Industry-Academy Cooperation, Saha-gu, Busan (KR)

( * ) Notice: Subject to any disclaimer, the term of this patent is extended or adjusted under 35 U.S.C. 154(b) by 447 days.

(21) Appl. No.: 13/387,833

(22) PCT Filed: Jul. 27, 2010

(86) PCT No.: PCT/KR2010/004914

§ 371 (c)(1),
(2), (4) Date: Jan. 30, 2012

(87) PCT Pub. No.: WO2011/016642

PCT Pub. Date: Feb. 10, 2011

(65) Prior Publication Data

US 2012/0132415 A1 May 31, 2012

(30) Foreign Application Priority Data

Aug. 3, 2009 (KR) ..... 10-2009-0071463

(51) Int. Cl.

| | |
|---|---|
| ***E21B 27/00*** | (2006.01) |
| ***E21B 49/08*** | (2006.01) |
| ***E21B 49/02*** | (2006.01) |

(52) U.S. Cl.

CPC ..... *E21B 49/02* (2013.01)
USPC ..... 166/107; 166/264; 175/59; 73/864.62

(58) Field of Classification Search

USPC ..... 166/107, 264; 175/59; 73/152.23, 73/152.55, 864.62

See application file for complete search history.

(56) References Cited

U.S. PATENT DOCUMENTS 4,317,490 A * 3/1982 Milberger et al. ..... 175/20

FOREIGN PATENT DOCUMENTS

| | | |
|---|---|---|
| JP | 62-135748 | 6/1987 |
| JP | 09-059968 | 3/1997 |
| JP | 09-072184 | 3/1997 |
| KR | 10-0330586 | 3/2002 |

* cited by examiner

*Primary Examiner* — Cathleen Hutchins
(74) *Attorney, Agent, or Firm* — John K. Park; Park Law Firm

(57) ABSTRACT

The present invention relates to an oil-pressure type fixed piston sampler for sampling a soil sample for site investigation. The oil-pressure type fixed piston sampler comprises a sampling unit (12) and an oil-pressure controller (14). Here, when the sampling unit (12) inserted into a drilled hole and a movable piston (80) moves downward, a sampling tube (1) moves downward to take a sample. The oil-pressure controller (14) connected with the sampling unit (12) controls oil pressure to cause the movable piston (80) to shift vertically. The sampling unit (12) comprises an upper head (20), a lower head (40), a piston housing (70), a rod block (100), a movable rod (90), a fixed piston (110), a fixed rod (92) and a separation rod (94). Since the sampling tube (1) takes a sample by a piston indentation method, high-quality, undisturbed samples can be obtained.

2 Claims, 5 Drawing Sheets

OIL-PRESSURE TYPE FIXED PISTON SAMPLER

TECHNICAL FIELD

The present invention relates to an oil pressure type fixed piston sampler, and more particularly, to such an oil pressure type fixed piston sampler which includes all the advantages of the hydraulic type and oil pressure type sampler, and can obtain high-quality samples while being operated and used in a simple and convenient manner through the improvement of the problems involved in a hydraulic type piston sampler in that the quality of a sample is deteriorated despite easy manipulation of the sampler, a mechanical type piston sampler in that its manipulation is difficult and much time is spent to manipulate the sampler despite good quality of undisturbed samples obtained, among the conventional fixed piston type samplers.

BACKGROUND ART

In general, a sampler that samples a soil sample for site investigation is classified variously depending on operation principle, sampling method, and pipe structure, and the like. Undisturbed samples are mainly sampled for the mechanical experiments such as consolidation test, permeability test, shear strength test, and the like, which are conducted on soft soil. In addition, samplers have been developed in various manners in terms of size and function to take such soil samples. However, a fixed piston type sampler is used mainly in that it is not limited in sampling depth, its operation is relatively simple, and good quality samples can be sampled.

Meanwhile, a free piston sampler is disclosed in that since a piston is not securely fixed to the piston type sampler when the press-in operation is performed and thus a friction between a sample and a sampling tube is large, it is difficult to take a sample but a device for preventing detachment of the sample is provided. In addition, a fixed piston type sampler is disclosed in which its structure is the same as that of the free piston sampler, but the recovery rate of samples can ensured up to 100% owing to a piston fixed thereto such that a correct sampling operation is possible and the sampler is effective in soft clay. By virtue of such advantages of the fixed piston, it is recently used mostly in a construction field. Examples of such a fixed piston type sampler include a hydraulic type piston sampler (ASTM D 6519-05, 2009) and a mechanical type piston sampler (JGS 1221-1995).

Korean patents associated with site investigation employing drilling equipment such as a piston type sampler are as follows:

First, Korean Patent Registration No. 10-0419257 entitled "METHOD AND APPARATUS FOR AUTOMATICALLY PERFORMING STANDARD PENETRATION TEST" is disclosed. In this patent, only a hammer is caused to drop on a ground in a state in which the hammer is lifted mechanically such that an additional penetration due to a drop impact or a loaded load is prevented while maintaining a constant drop height when striking the hammer by a free drop, thereby enabling penetration of a sampler by a correct strike, preventing the erroneous operation of a worker through the automatic measurement of the numbers of strikes of the hammer each time the hammer is struck, and making it possible to determine whether the test continues to be performed or is suspended through the automatic measurement of the amount of penetrations of the sampler to calculate the number of strikes as a final result. In addition, a method and apparatus for automatically performing a standard penetration test (SPT) is suggested which includes a control device for recording and outputting a test result while helping perform the test in a blanket and automatic manner by controlling the driving of the devices such that a correct test result can be obtained.

Second, Korean Patent Registration No. 10-0355400 entitled "VERY LARGE DIAMETER (VLD) SAMPLER" is disclosed. In this patent, disturbance of soil can be minimized and a large-scale undisturbed sample having a diameter of more than 300 mm in various depths can be sampled in a natural sample sampling process for correctly evaluating the engineering characteristics of a soft ground as a criterion of the review of constructionability, stability, and economic efficiency in a construction work in a river or offshore area where the soft ground is distributed.

Third, Korean Patent Registration No. 10-0356283 entitled "LARGE DIAMETER SAMPLER ENABLING UNDISTURBED SAMPLES TO BE GATHERED" is disclosed. In this patent, high-quality undisturbed samples can be gathered even in a clay or loamy sand ground upon the site investigation such that the gathering of the undisturbed samples is possible which can obtain more correctly the parameters of the ground necessary in the basic design of a structure.

Fourth, Korean Patent Registration No. 10-0768686 entitled "PICKING APPARATUS OF A SOIL SAMPLE" is disclosed. In this patent, the apparatus is configured in a simple structure such that a strike rod for striking a ground is lifted and freely drops periodically by rotating a pair of rollers to take a soil sample.

As discussed above, the conventional prior arts suggest large diameter samplers with a diameter of 30 cm or more (see the second and third patent documents) which does not employ a sampling tube like the piston type sampler, or samplers (see the first and fourth patent documents) for taking disturbed samples. That is, the patent techniques associated with the piston type sampler mainly used in a construction field are not suggested or taught.

The advantages and disadvantages of the fixed piston sampler presently used will be discussed hereinafter.

Among the fixed piston type samplers, the hydraulic type piston sampler has an advantage in that assembly, operation, disassembly, and use thereof is easy, but still entails several disadvantages in that there is a limitation in the control of the advancement speed and the advancement of the sampler, and in that "a vacuum removing valve" needed when separating a piston from the sampling tube containing a sample is not included in the sampler. In addition, the mechanical type piston sampler has an advantage in that it can satisfy the requirements for a multi-purpose sampler more fully as compared to the hydraulic type piston sampler, but encounters a disadvantage in that its manipulation is complicated and sampling costs are expensive. That is, the hydraulic type piston samplers widely used in Korea have a problem in that its manipulation is easy but the quality of a sample is deteriorated. Also, the mechanical type piston samplers used rarely has an advantage in that good quality undisturbed samples can be obtained, but still a problem in that its manipulation is difficult and much time is spent to manipulate the samplers.

DISCLOSURE OF INVENTION

Technical Problem

Accordingly, the present invention has been made in order to improve the above-described problems occurring in the prior art, and it is an object of the present invention is to provide a novel oil pressure type fixed piston sampler, which can obtain high-quality undisturbed samples while making its manipulation easy.

Particularly, an another object of the present invention is to provide a novel oil pressure type fixed piston sampler, which includes all the advantages of the hydraulic type and oil pressure type sampler, and can obtain high-quality samples while being operated and used in a simple and convenient manner in view of the problems involved in a hydraulic type piston sampler in that the quality of a sample is deteriorated despite easy manipulation of the sampler, a mechanical type piston sampler in that its manipulation is difficult and much time is spent to manipulate the sampler despite good quality of undisturbed samples obtained, among the conventional fixed piston type samplers.

Technical Solution

To achieve the above objects, according to a feature of the present invention, there is provided an oil pressure type fixed piston sampler including: a sampling unit 12 configured to be inserted into a drilled hole such that when a movable piston 80 moves downward, a sampling tube 1 moves downward to take a sample; and an oil-pressure controller 14 connected to the sampling unit 12 and configured to control oil pressure to cause the movable piston 80 to move vertically, wherein the sampling unit 12 includes: an upper head 20 disposed above the movable piston 80; a lower head 40 disposed below the movable piston 80; a piston housing 70 joiningly disposed between the upper head 20 and the lower head 40 and configured to accommodate the movable piston 80 therein to cause the movable piston 80 to move vertically in the piston housing 70; a rod block 100 disposed below the lower head 40 and fixed to an upper side of the sampling tube 1; a movable rod 90 disposed to pass through the lower head 40 to cause the movable rod to move vertically with it being supported by the lower head 40, the movable rod being joined at one end thereof to the movable piston 80 and joined at the other end thereof to the rod block 100 such that the rod block 100 is operated in cooperation with the movable rod 90 by the vertical movement of the movable piston 80; a fixed piston 110 disposed to move vertically within the sampling tube 1; a fixed rod 92 disposed at the inside of the movable rod 90 to cause the movable piston 80 and the movable rod 90 to move vertically, the fixed rod being joined at one end thereof to the upper head 20 and joined at the other end thereof to the fixed piston 110 while passing through the rod block 100, the lower head 40, and the movable piston 80 such that the fixed piston 110 is supported by the fixed rod 92; and a separation rod 94 disposed at the inside of the fixed rod 92 so as to move vertically, the separation rod being joined at one end thereof to the fixed piston 110 and exposed at the other end thereof outwardly from the top of the upper head 20 while passing through the upper head.

In the oil pressure type fixed piston sampler according to the present invention, the sampling unit 12 may allow the upper head 20 and the oil pressure controller 14 to be connected to each other through a first external oil pressure line 16 such that oil pressure permitting the movable piston 80 to move downward is supplied to the piston housing 70 from the oil pressure controller 14 through an internal oil pressure line 26 of the upper head 20 and simultaneously is supplied to the lower head 40, and may allow oil pressure permitting the movable piston 80 to move upward is supplied to the lower side of the piston housing 70 from the oil pressure controller 14 through a second external oil pressure line 18. In addition, the sampling unit 12 may further include a clamping piston 60 which is disposed around the side faces of the upper and lower heads 20 and 40, and is protruded outwardly from the side faces of the upper and lower heads 20 and 40 by oil pressure introduced through the upper head 20 such that the sampling unit 12 is fixed in position within the drilled hole.

In the oil pressure type fixed piston sampler according to the present invention, the movable piston 80 may further include a cushion protrusion 82 formed at the lower side thereof and having an outer diameter larger than that of the movable rod 90, and the lower head 40 may further include a cushion pocket 50 having a space defined at an upper portion thereof so as to allow the cushion protrusion 82 to be inserted thereto.

Advantageous Effects

According to oil-pressure type fixed piston sampler 10 of the present invention, the sampling unit 12 is driven by oil pressure under the control of the oil-pressure controller 14, so that the press-in speed can be controlled at a uniform high speed. Particularly, the sample unit 12 of the oil pressure type fixed piston sampler 10 according to this embodiment is collected to a site on the ground after taking a sample, and then the lower drain hole 116 formed on the bottom plate 112 of the fixed piston 110 is opened by turning a stopper 94*a* at the top of the separation rod 94 such that vacuum or water present between the bottom plate 112 of the fixed piston 110 and the sampling tube 1 is excluded, thereby obtaining high-quality undisturbed samples. In addition, since the sampling tube 1 takes a sample by a piston press-in method, high-quality undisturbed samples can be obtained. A further advantage is that as the sampling unit 12 is securely fixed inside the drilled hole along the central axis of the drilled hole by a clamping piston 60 disposed around the side faces of the upper and lower heads 20 and 40, the sampling process can be done based on a stable support.

BEST MODE FOR CARRYING OUT THE INVENTION

Figure 1:
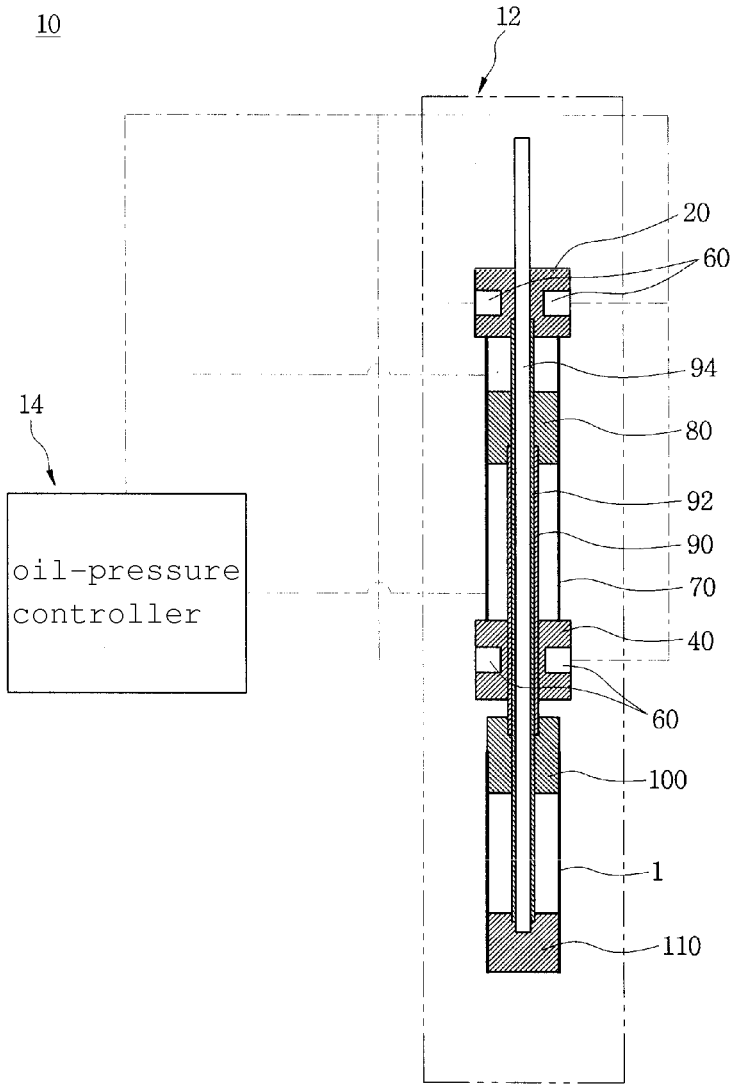
FIG. 1 is a diagrammatic view illustrating a technical spirit of an oil pressure type fixed piston sampler according to the present invention.
Figure 2:
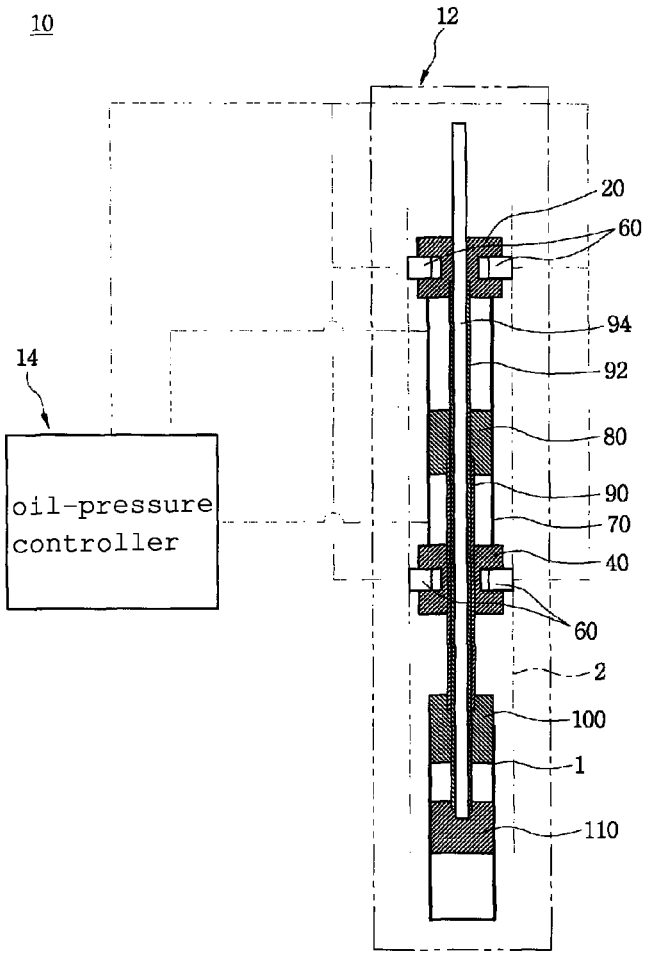
FIG. 2 is a diagrammatic view illustrating an oil pressure type fixed piston sampler according to the present invention in which a sampling unit is operated to take a sample.

FIG. 1 is a diagrammatic view illustrating a technical spirit of an oil pressure type fixed piston sampler according to the present invention, and FIG. 2 is a diagrammatic view illustrating an oil pressure type fixed piston sampler according to the present invention in which a sampling unit is operated to take a sample.

Referring to FIGS. 1 and 2, an oil pressure type fixed piston sampler 10 according to the present invention includes a sampling unit 12 and an oil pressure controller 14. The sampling unit 12 is inserted into a drilled hole such that when a movable piston 80 moves downward, a sampling tube 1 moves downward to take a sample. In addition, the oil-pressure controller 14 is connected to the sampling unit 12 and is configured to control oil pressure to cause the movable piston 80 to move vertically.

In such an oil pressure type fixed piston sampler according to the present invention 10, the sampling unit 12 is inserted into a drilled hole formed by drilling equipment to take a soil sample from the bottom of the drilled hole in the same manner as in a general fixed piston type sampler. In this specification, the drilled hole is generally the surface of a drilled hole, or the inner surface of a housing 2 when the housing 2 is installed inside the drilled hole. In addition, the sampling unit 12 is inserted into the drilled hole with it being fixed to the drilling equipment.

In the oil-pressure type fixed piston sampler 10 according to the present invention, the sampling unit 12 is driven by oil pressure under the control of the oil-pressure controller 14, so that the press-in speed can be controlled at a uniform high speed. In addition, since the sampling tube 1 takes a sample by a piston press-in method, high-quality undisturbed samples can be obtained.

More specifically, in the oil pressure type fixed piston sampler 10 according to the present invention, the sampling unit 12 includes an upper head 20, a lower head 40, a piston housing 70, a rod block 100, a movable rod 90, a fixed piston 110, a fixed rod 92, and a separation rod 94.

The upper head 20 is disposed above the movable piston 80, and the lower head 40 is disposed below the movable piston 80. The piston housing 70 is joiningly disposed between the upper head 20 and the lower head 40 and is configured to accommodate the movable piston 80 therein to cause the movable piston 80 to move vertically in the piston housing 70. The rod block 100 is disposed below the lower head 40 and is fixed to an upper side of the sampling tube 1. The movable rod 90 is disposed to pass through the lower head 40 to cause the movable rod to move vertically with it being supported by the lower head 40. The movable rod 90 is joined at one end thereof to the movable piston 80 and is joined at the other end thereof to the rod block 100 such that the rod block 100 is operated in cooperation with the movable rod 90 by the vertical movement of the movable piston 80. The fixed piston 110 is disposed to move vertically within the sampling tube 1. The fixed rod 92 is disposed at the inside of the movable rod 90 to cause the movable piston 80 and the movable rod 90 to move vertically. In addition, the fixed rod 92 is joined at one end thereof to the upper head 20 and is joined at the other end thereof to the fixed piston 110 while passing through the rod block 100, the lower head 40, and the movable piston 80 such that the fixed piston 110 is supported by the fixed rod 92. Also, the separation rod 94 is disposed at the inside of the fixed rod 92 so as to move vertically, and is joined at one end thereof to the fixed piston 110 and is exposed at the other end thereof outwardly from the top of the upper head 20 while passing through the upper head.

The oil pressure type fixed piston sampler 10 according to the present invention allows the fixed rod 92 to fix the fixed piston 110 to the upper head 20 such that the vertical position thereof is not changed. In addition, the rod block 100 joined to the sampling tube 1 is fixedly connected to the movable piston 80 by the movable rod 90, and thus moves vertically along with the movement of the movable piston 80.

By virtue of this configuration, the oil pressure type fixed piston sampler 10 according to the present invention is inserted into a drilled hole with the upper head 20 being fixed to drilling equipment (referring to a device for allowing the sampling unit 12 to be inserted into or withdrawn from the drilled hole), and the oil-pressure controller 14 moves the movable piston 80 downward under the control thereof as shown in FIG. 2 so as to take a sample into the sampling tube 1. In other words, when the movable piston 80 moves downward with the oil pressure type fixed piston sampler 10 being inserted into the drilled hole, the rod block 100 operated in cooperation with the movable piston 80 by the movable rod 90 moves downward and simultaneously the sampling tube 1 moves downward so as to take a sample.

Meanwhile, the oil pressure type fixed piston sampler according to the present invention allows the sampling unit 12 to be securely fixed inside the drilled hole along the central axis of the drilled hole by a clamping piston (60) disposed around the side faces of the upper and lower heads 20 and 40, so that the sampling process can be done based on a stable support. That is, when the sampling unit 12 is inserted into the drilled hole and then reaches a predetermined position, the clamping pistons 60 are operated by oil pressure supplied from the oil pressure controller 14 such that the sampling unit 12 is fixed in position in the drilled hole or the inner surface of the housing 2 to cause the sampling unit 12 to be supported along the central axis of the drilled hole as shown in FIG. 2.

Hereinafter, an oil pressure type fixed piston sampler according to a preferred embodiment of the present invention will be described in further detail with reference to FIGS. 3 to 7. It should be noted that the same elements or parts are denoted by the same reference numerals in FIGS. 1 to 7. In the meantime, in the detailed description and the accompanying drawings, illustration and explanation on the construction and operational effects which a person skilled in the art can easily understand from a general fixed piston type sampler will be briefly made or will be omitted to avoid redundancy, and only portions related with the present invention will be shown and described.

Figure 3:
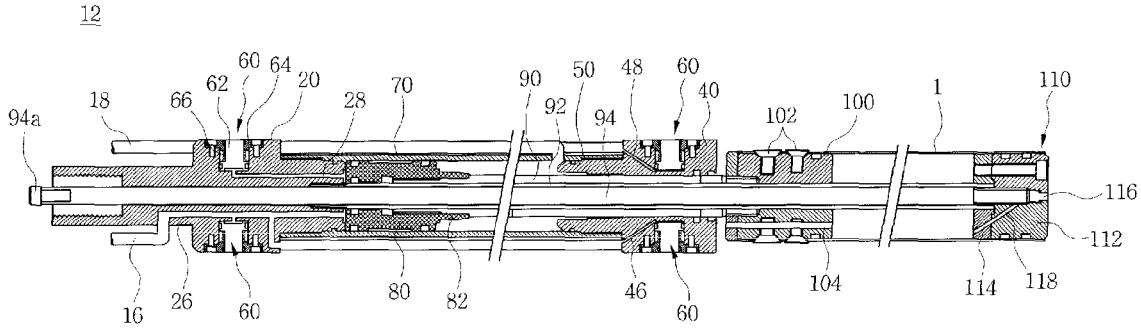
FIG. 3 is a cross-sectional view illustrating the main construction of a sampling unit in an oil pressure type fixed piston sampler according to a preferred embodiment of the present invention.
Figure 4:
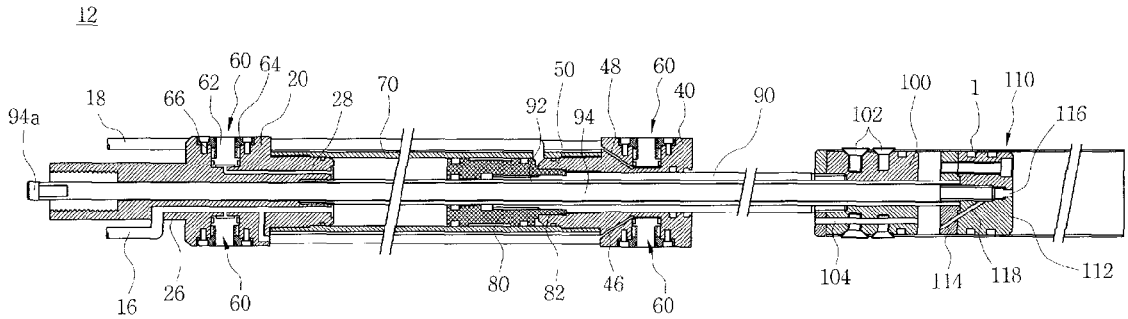
FIG. 4 is a cross-sectional view illustrating the oil pressure type fixed piston sampler shown in FIG. 3 in which a sampling unit is operated to take a sample.
Figure 5:
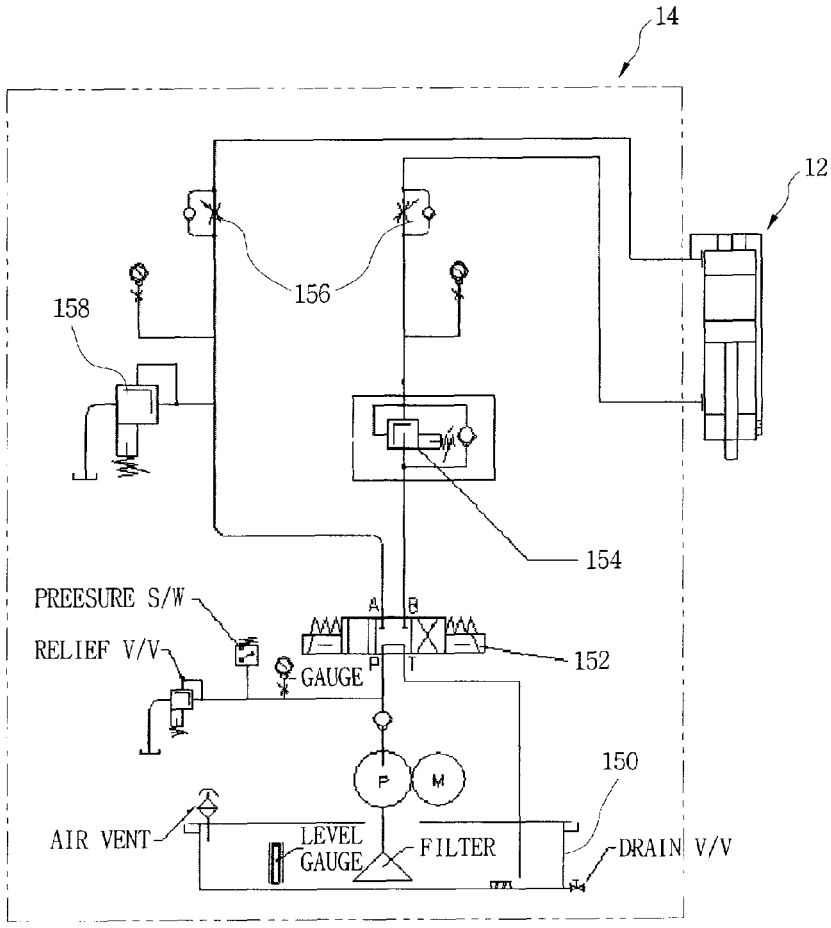
FIG. 5 is a cross-sectional view illustrating the main construction of an oil pressure controller in an oil pressure type fixed piston sampler according to a preferred embodiment of the present invention.
Figure 6:
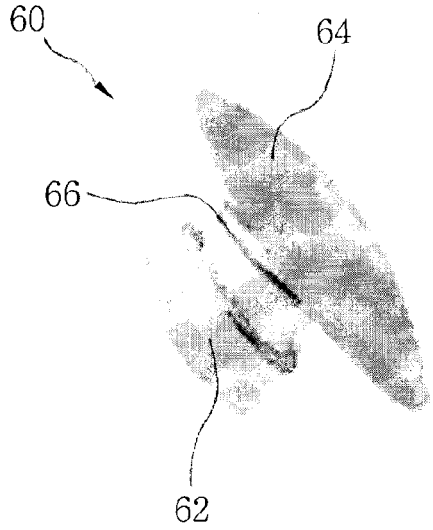
FIG. 6 is a perspective view illustrating a claiming piston in an oil pressure type fixed piston sampler according to a preferred embodiment of the present invention.
Figure 7:
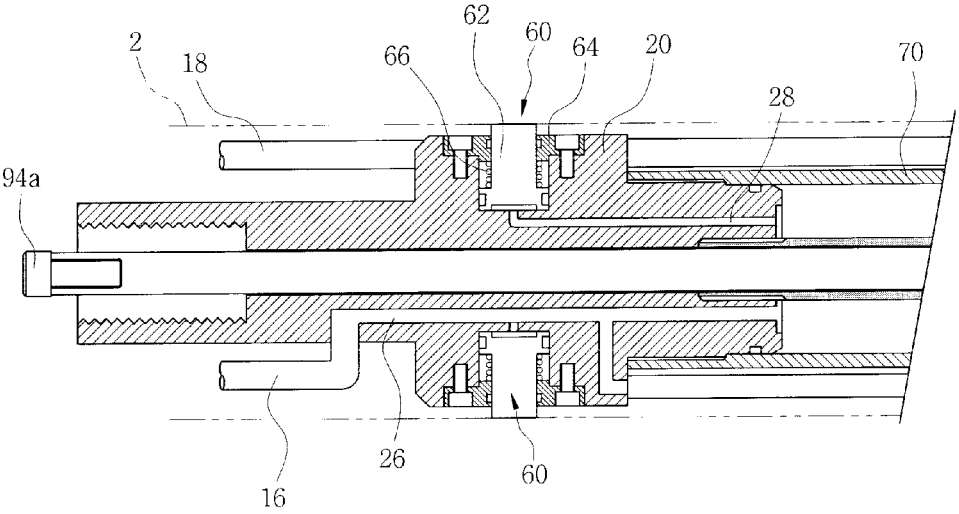
FIG. 7 is a cross-sectional view illustrating the clamping piston shown in FIG. 6.

FIG. 3 is a cross-sectional view illustrating the main construction of a sampling unit in an oil pressure type fixed piston sampler according to a preferred embodiment of the present invention, FIG. 4 is a cross-sectional view illustrating the oil pressure type fixed piston sampler shown in FIG. 3 in which a sampling unit is operated to take a sample, FIG. 5 is a cross-sectional view illustrating the main construction of an oil pressure controller in an oil pressure type fixed piston sampler according to a preferred embodiment of the present invention, FIG. 6 is a perspective view illustrating a claiming piston in an oil pressure type fixed piston sampler according to a preferred embodiment of the present invention, and FIG. 7 is a cross-sectional view illustrating the clamping piston shown in FIG. 6.

Referring to FIGS. 3 to 5, an oil pressure type fixed piston sampler 10 according to a preferred embodiment of the present invention includes a sampling unit 12 and an oil pressure controller 14. The sampling unit 12 is inserted into a drilled hole such that when a movable piston 80 moves downward, a sampling tube 1 moves downward to take a sample. In addition, the oil-pressure controller 14 is connected to the sampling unit 12 and is configured to control oil pressure to cause the movable piston 80 to move vertically.

In the oil pressure type fixed piston sampler 10 according to a preferred embodiment of the present invention, the sampling unit 12 includes an upper head 20, a lower head 40, a clamping piston 60, a piston housing 70, a rod block 100, a movable rod 90, a fixed piston 110, a fixed rod 92, and a separation rod 94.

The upper head 20 is disposed above the movable piston 80, and the lower head 40 is disposed below the movable piston 80. The piston housing 70 is joiningly disposed between the upper head 20 and the lower head 40 and is configured to accommodate the movable piston 80 therein to cause the movable piston 80 to move vertically in the piston housing 70.

In this embodiment, the sampling unit 12 allows the upper head 20 and the oil pressure controller 14 to be connected to each other through a first external oil pressure line 16 such that oil pressure permitting the movable piston 80 to move downward is supplied to the piston housing 70 from the oil pressure controller 14 through an internal oil pressure line 26 of the upper head 20 and simultaneously is supplied to the lower head 40. In addition, the sampling unit 12 allows oil pressure permitting the movable piston 80 to move upward is supplied to the lower side of the piston housing 70 from the oil pressure controller 14 through a second external oil pressure line 18.

In this case, the clamping piston 60 is disposed around the side faces of the upper and lower heads 20 and 40, and is protruded outwardly from the side faces of the upper and lower heads 20 and 40 by oil pressure introduced through the upper head 20 such that the sampling unit 12 is fixed in position within the drilled hole. That is, the clamping piston 60 of the upper head 20 is installed so as to fluidically communicate with the internal oil pressure line 26 of the upper head 20, and the clamping piston 60 of the lower head 40 is installed so as to fluidically communicate with the internal oil pressure line 46 of the lower head 40 such that the clamping piston 60 is operated through oil pressure introduced through the upper head 20.

As shown in FIGS. 6 and 7, the claiming piston 60 includes a plunger 62 which is protruded outwardly by oil pressure, a spring 66 for returning the plunger 62 to its original position when the oil pressure is released, and a cover 64 configured to support the plunger 62 and the spring 66 and fixed each of the upper and lower heads 20 and 40. The spring 66 is mounted between the plunger 62 and the cover 64. Since a tension of the spring 66 is larger than initial oil pressure, the plunger 62 is influenced by the force of the spring 66. Thus, when pressurized oil from a pump of the oil pressure controller 14 is introduced into the clamping piston 60, the pressure of the oil is larger than a modulus of elasticity of the spring to cause the plunger 62 to be moved outwardly from the upper and lower heads 20 and 40 such that the plunger 62 is brought into close contact with the housing 2. That is, since the modulus of elasticity of the spring is set to be not larger than a back pressure of oil, the claiming piston 60 is first operated and then the movable piston 80 moves to take a sample.

The sampling unit 12 of the oil pressure type fixed piston sampler 10 according to this embodiment having the above configuration allows the upper head 20 to be connected to a drilling rod of the drilling equipment. In addition, preferably, three clamping pistons 60 are disposed around the side faces of the upper head 20 and the lower head 40 such that they are expanded horizontally by oil pressure, and thus the sampling unit 12 is fixed in position within the housing (see FIG. 7). Thus, the claiming piston 60 is positioned in the middle of the housing 2 during the sampling.

Besides, in the sampling unit 12 of the oil pressure type fixed piston sampler 10 according to this embodiment, the movable piston 80 includes a cushion protrusion 82 formed at the lower side thereof and having an outer diameter larger than that of the movable rod 90, and the lower head 40 includes a cushion pocket 50 having a space defined at an upper portion thereof so as to allow the cushion protrusion 82 to be inserted thereto such that a cushioning effect is provided. That is, the movable piston 80 is controlled constantly in advance speed by oil pressure through a pressurization and discharge valve of the oil pressure controller 14. In order to alleviate an impact which may occur when the sampling tube 1 reaches a given depth during the sampling, when the movable piston 80 is moved by a predetermined length, surplus oil is discharged by the action of the cushion protrusion 82 and the cushion pocket 50 such that the movable piston 80 is promptly stopped effectively.

Referring back to FIGS. 3 and 4, in the oil pressure type fixed piston sampler 10 according to this embodiment, the rod block 100 of the sampling unit 10 is disposed below the lower head 40 and is fixed to an upper side of the sampling tube 1. In addition, the fixed piston 110 is disposed to move vertically within the sampling tube 1. In this case, the fixed piston 110 is fixed to the upper head 20 by the fixed rod 92 such that the vertical position thereof is not changed. In addition, the rod block 100 joined to the sampling tube 1 is fixedly connected to the movable piston 80 by the movable rod 90, and thus moves vertically along with the movement of the movable piston 80.

That is, the movable rod 90 is disposed to pass through the lower head 40 to cause the movable rod to move vertically with it being supported by the lower head 40. The movable rod 90 is joined at one end thereof to the movable piston 80 and is joined at the other end thereof to the rod block 100 such that the rod block 100 is operated in cooperation with the movable rod 90 by the vertical movement of the movable piston 80. The fixed rod 92 is disposed at the inside of the movable rod 90 to cause the movable piston 80 and the movable rod 90 to move vertically. In addition, the fixed rod 92 is joined at one end thereof to the upper head 20 and is joined at the other end thereof to the fixed piston 110 while passing through the rod block 100, the lower head 40, and the movable piston 80 such that the fixed piston 110 is supported by the fixed rod 92. Also, the separation rod 94 is disposed at the inside of the fixed rod 92 so as to move vertically, and is joined at one end thereof to the fixed piston 110 and is exposed at the other end thereof outwardly from the top of the upper head 20 while passing through the upper head.

In this case, the fixed piston 110 includes a lower drain hole 116 penetratingly formed on a bottom plate 112 of the fixed piston to which the separation rod 94 is joined, and an upper drain hole 114 such that the lower drain hole 116 fluidically communicates with the upper drain hole 114 blocked by the joining of the separation rod 94 to the fixed piston. Also, the rod block 100 includes a sub drain hole 104 formed therein so as to be penetrated vertically. By virtue of this configuration, water or air introduced into the sampling tube 1 upon the taking of a sample can be discharged to the outside rapidly. Moreover, the separation rod 94 is configured to allow the upper and the lower drain holes 114 and 116 of the fixed piston 110 to be blocked during the sampling, and to be rotated in the upper head 20 such that vacuum present between the sample and the sampling tube 1 can be excluded after taking the sample.

By virtue of this configuration, the oil pressure type fixed piston sampler 10 according to the present invention is inserted into a drilled hole with the upper head 20 being fixed to drilling equipment, and the oil-pressure controller 14 moves the movable piston 80 downward under the control thereof as shown in FIG. 2 so as to take a sample into the sampling tube 1. In other words, when the movable piston 80 moves downward with the oil pressure type fixed piston sampler 10 being inserted into the drilled hole, the rod block 100 operated in cooperation with the movable piston 80 by the movable rod 90 moves downward and simultaneously the sampling tube 1 moves downward so as to take a sample.

Referring to FIG. 5, in the oil pressure type fixed piston sampler 10 according to a preferred embodiment of the present invention, the oil pressure controller 14 controls oil pressure supplied to the sampling unit 12 from the drilling equipment. Hydraulic oil is moved to the sampling unit from a hydraulic oil tank 150 of the drilling equipment via a hydraulic hose (i.e., flexible pipeline). The hydraulic hose is typically wound around a reel, and thus is easily wound and unwound in a semi-automatic manner. The oil pressure controller 14 is preferably mounted at the drilling equipment.

In this case, the oil pressure controller 14 includes a relief valve 158, a throttle valve 156, a counter balance valve 154, and a manual valve 152. The oil pressure controller 14 is previously connected to a hydraulic system installed to apply oil pressure to the drilling equipment. Here, the manual valve 152 is connected to a lever so that a worker can manipulate the manual valve. The manual valve 152 is a valve that is used to change the operation direction of the movable piston 80 manually. When the movable piston 80 advances, the manual valve 152 controls hydraulic oil to flow to a port A from a pump. When the movable piston 80 retracts, the manual valve 152 controls hydraulic oil to flow to a port B from the pump to change a flow channel of the hydraulic oil. In addition, the relief valve 158 acts to sense the pressure of a line such that when the pressure exceeds a predetermined pressure, the relief valve 158 is opened to cause hydraulic oil to flow to the hydraulic oil tank 150 (i.e., drain port) to prevent the line pressure from exceeding the predetermined pressure. In addition, the throttle valve 156 controls the rate of the hydraulic oil flowing therethrough in a stepless control manner. Further, since the counter balance valve 154 is attached to a pipeline returning to the hydraulic oil tank 150, it prevents the unlimited movement of the movable piston 80 due to an external force applied to the movable piston 80. That is, a value larger than a resistance applied from soil upon the advancement of the movable piston 80 is set as a back pressure such that the movable piston 80 can advance at a constant speed irrespective of the resistance.

The operation of the oil pressure type fixed piston sampler 10 according to this embodiment will be described hereinafter.

First, the lever of the manual valve 152 is manipulated to change a flow channel to cause hydraulic oil to flow to the port A from the pump. Then, the hydraulic oil passed through the port A flows to the upper side of the piston housing 70 through the upper head 20 of the sampling unit 12 via the throttle valve 156. At this time, since a degree of opening of the throttle valve 156 can be controlled in a variable manner, the rate of hydraulic oil flowing to the sampling unit 12 can be changed variably. However, if high pressure is applied to the inside of the flow channel, the hydraulic oil flowing in the flow channel returns to the hydraulic oil tank 150 through the relief valve 158 before entering the throttle valve 156. Of course, it is to be noted that the relief valve 158 is designed to set the pressure of the flow channel in a variable manner.

In this case, some of the hydraulic oil flowing into the upper head 20 also flows to the clamping piston 60. Of course, it is to be noted that the same manner as in the above case is also applied to the clamping piston 60 disposed around the lower head 40. When the clamping piston 60 is applied with no pressure, it is held in the lowest stroke position as an elastic force of the spring 66 is applied to the plunger 62. On the other hand, when the hydraulic oil is introduced into the clamping piston 60 and the pressure thereof is larger than the elastic force of the spring, the plunger 62 is protruded outwardly such that the sampling unit 12 is fixed in position within the housing 2. In this case, since a modulus of elasticity of the spring is designed such that the force needed for clamping is smaller than a difference between the oil pressure applied to the plunger and the back pressure applied in front of the movable piston 80, the claiming first occurs and the movable piston 80 advances, i.e., moves downward.

In this embodiment, the movable piston 80 is designed such that it advances up to a predetermined stroke length, i.e., 840 mm to prevent the sample from being disturbed. In addition, a cushioning function is provided by a cushion protrusion 82 formed at the bottom of the movable piston 80 and a cushion pocket 50 formed at the top of the lower head such that when the movable piston 80 reaches the predetermined stroke position, no impact is applied to the movable piston 80, and the cushion protrusion 82 and the cushion pocket 50 serve as clutches to prevent the sampling tube 1 from being shaken after sampling.

Through this process, when the sampling operation is completed, the operation of the pump is stopped to avoid no pressure from being to applied to movable piston 80. In this case, the pressure before and after the operation of the movable piston 80 is maintained in an equilibrium state. In addition, when the counter balance valve 154 is manipulated to remove the back pressure applied to the movable piston 80, the clamping piston 60 is released from a clamping state while returning to its original position. Further, the retraction, i.e., the upward movement of the movable piston 80, which may be caused by the back pressure, is prevented. Thereafter, the sampling unit 12 is lifted above the ground and the sampling tube 1 is removed from the sampling unit 12. Then, the lever of the manual valve 152 is manipulated to change the operation direction of the manual valve such that the hydraulic oil flows to the port B to retract the movable piston 80.

As such, the sample unit 12 of the oil pressure type fixed piston sampler 10 according to this embodiment is collected to a site on the ground after taking a sample, and then the lower drain hole 116 formed on the bottom plate 112 of the fixed piston 110 is opened by turning a stopper 94*a* at the top of the separation rod 94 such that vacuum or water present between the bottom plate 112 of the fixed piston 110 and the sampling tube 1 is excluded, thereby obtaining high-quality undisturbed samples. A further advantage is that as the sampling unit 12 is securely fixed inside the drilled hole along the central axis of the drilled hole by a clamping piston 60 disposed around the side faces of the upper and lower heads 20 and 40, the sampling process can be done based on a stable support.

While the oil pressure type fixed piston sampler according to a preferred embodiment of the present invention have been described, it will be readily appreciated by those skilled in the art that it is merely illustrative of the preferred embodiments of the present invention and various modifications and changes can be made thereto within the technical spirit and scope of the present invention.

BEST MODE

According to a preferred embodiment of the present invention, there is provided an oil pressure type fixed piston sampler including: a sampling unit 12 configured to be inserted into a drilled hole such that when a movable piston 80 moves downward, a sampling tube 1 moves downward to take a sample; and an oil-pressure controller 14 connected to the sampling unit 12 and configured to control oil pressure to cause the movable piston 80 to move vertically, wherein the sampling unit 12 includes: an upper head 20 disposed above the movable piston 80; a lower head 40 disposed below the movable piston 80; a piston housing 70 joiningly disposed between the upper head 20 and the lower head 40 and configured to accommodate the movable piston 80 therein to cause the movable piston 80 to move vertically in the piston housing 70; a rod block 100 disposed below the lower head 40 and fixed to an upper side of the sampling tube 1; a movable rod 90 disposed to pass through the lower head 40 to cause the movable rod to move vertically with it being supported by the lower head 40, the movable rod being joined at one end thereof to the movable piston 80 and joined at the other end thereof to the rod block 100 such that the rod block 100 is operated in cooperation with the movable rod 90 by the vertical movement of the movable piston 80; a fixed piston 110 disposed to move vertically within the sampling tube 1; a fixed rod 92 disposed at the inside of the movable rod 90 to cause the movable piston 80 and the movable rod 90 to move vertically, the fixed rod being joined at one end thereof to the upper head 20 and joined at the other end thereof to the fixed piston 110 while passing through the rod block 100, the lower head 40, and the movable piston 80 such that the fixed piston 110 is supported by the fixed rod 92; and a separation rod 94 disposed at the inside of the fixed rod 92 so as to move vertically, the separation rod being joined at one end thereof to the fixed piston 110 and exposed at the other end thereof outwardly from the top of the upper head 20 while passing through the upper head. The movable piston 80 may further include a cushion protrusion 82 formed at the lower side thereof and having an outer diameter larger than that of the movable rod 90, and the lower head 40 may further include a cushion pocket 50 having a space defined at an upper portion thereof so as to allow the cushion protrusion 82 to be inserted thereto.

In the meantime, preferably, the sampling unit 12 may allow the upper head 20 and the oil pressure controller 14 to be connected to each other through a first external oil pressure line 16 such that oil pressure permitting the movable piston 80 to move downward is supplied to the piston housing 70 from the oil pressure controller 14 through an internal oil pressure line 26 of the upper head 20 and simultaneously is supplied to the lower head 40, and may allow oil pressure permitting the movable piston 80 to move upward is supplied to the lower side of the piston housing 70 from the oil pressure controller 14 through a second external oil pressure line 18. In addition, preferably, the sampling unit 12 may further include a clamping piston 60 which is disposed around the side faces of the upper and lower heads 20 and 40, and is protruded outwardly from the side faces of the upper and lower heads 20 and 40 by oil pressure introduced through the upper head 20 such that the sampling unit 12 is fixed in position within the drilled hole.

INDUSTRIAL APPLICABILITY

The present invention includes the advantages of the hydraulic type and oil pressure type sampler, and can obtain high-quality samples while being operated and used in a simple and convenient manner. Thus, the effect of the present invention on the industrial fields is expected to remarkably increase.

The invention claimed is:

1. An oil pressure type fixed piston sampler comprising:

a sampling unit 12 configured to be inserted into a drilled hole such that when a movable piston 80 moves downward, a sampling tube 1 moves downward to take a sample; and an oil-pressure controller 14 connected to the sampling unit 12 and configured to control oil pressure to cause the movable piston 80 to move vertically, wherein the sampling unit 12 comprises:

an upper head 20 disposed above the movable piston 80;

a lower head 40 disposed below the movable piston 80;

a piston housing 70 joiningly disposed between the upper head 20 and the lower head 40 and configured to accommodate the movable piston 80 therein to cause the movable piston 80 to move vertically in the piston housing 70;

a rod block 100 disposed below the lower head 40 and fixed to an upper side of the sampling tube 1;

a movable rod 90 disposed to pass through the lower head 40 to cause the movable rod to move vertically and be supported by the lower head 40, the movable rod being joined at one end thereof to the movable piston 80 and joined at the other end thereof to the rod block 100 such that the rod block 100 is operated in cooperation with the movable rod 90 by the vertical movement of the movable piston 80;

a fixed piston 110 disposed to move vertically within the sampling tube 1;

a fixed rod 92 disposed at the inside of the movable rod 90 to cause the movable piston 80 and the movable rod 90 to move vertically, the fixed rod being joined at one end thereof to the upper head 20 and joined at the other end thereof to the fixed piston 110 while passing through the rod block 100, the lower head 40, and the movable piston 80 such that the fixed piston 110 is supported by the fixed rod 92; and a separation rod 94 disposed at the inside of the fixed rod 92 so as to move vertically, the separation rod being joined at one end thereof to the fixed piston 110 and exposed at the other end thereof outwardly from the top of the upper head 20 while passing through the upper head, wherein the movable piston 80 further comprises a cushion protrusion 82 formed at the lower side thereof and having an outer diameter larger than that of the movable rod 90, and wherein the lower head 40 further comprises a cushion pocket 50 having a space defined at an upper portion thereof so as to allow the cushion protrusion 82 to be inserted thereto.

2. The oil pressure type fixed piston sampler according to claim 1, wherein the sampling unit 12 allows the upper head 20 and the oil pressure controller 14 to be connected to each other through a first external oil pressure line 16 such that oil pressure permitting the movable piston 80 to move downward is supplied to the piston housing 70 from the oil pressure controller 14 through an internal oil pressure line 26 of the upper head 20 and simultaneously is supplied to the lower head 40, wherein the sampling unit 12 allows oil pressure permitting the movable piston 80 to move upward is supplied to the lower side of the piston housing 70 from the oil pressure controller 14 through a second external oil pressure line 18, and wherein the sampling unit 12 further comprises a clamping piston 60 which is disposed around the side faces of the upper and lower heads 20 and 40, and is protruded outwardly from the side faces of the upper and lower heads 20 and 40 by oil pressure introduced through the upper head 20 such that the sampling unit 12 is fixed in position within the drilled hole.

* * * * *